US006238259B1

(12) United States Patent
Medina

(10) Patent No.: US 6,238,259 B1
(45) Date of Patent: May 29, 2001

(54) BALLOON NOVELTY DEVICE

(76) Inventor: Vincent Medina, 225 Blakeslee, #127, North Hollywood, CA (US) 91601

( * ) Notice: Subject to any disclaimer, the term of this patent is extended or adjusted under 35 U.S.C. 154(b) by 0 days.

(21) Appl. No.: 08/676,543

(22) Filed: Jul. 9, 1996

(51) Int. Cl.[7] ..... A63H 33/00; A63H 3/06

(52) U.S. Cl. ..... 446/71; 446/220; 446/488; 40/212; 40/124.01

(58) Field of Search ..... 446/71, 75, 77, 446/220, 488, 147; 40/210, 212, 215, 217, 124.01, 124.08, 610; 116/210; 472/68

(56) References Cited

U.S. PATENT DOCUMENTS

| | | | | |
|---|---|---|---|---|
| 2,380,587 | * | 7/1945 | Fenton | 116/210 |
| 2,701,935 | * | 2/1955 | Florence | 446/225 |
| 2,923,917 | * | 2/1960 | McPherson et al. | 116/210 X |
| 3,147,560 | * | 9/1964 | Berger et al. | 40/610 |
| 3,267,604 | * | 8/1966 | Goldsmith | 446/220 |
| 3,526,202 | * | 9/1970 | Graulich | 116/210 |
| 3,941,384 | * | 3/1976 | Wopschall | 446/220 |
| 4,042,882 | * | 8/1977 | Canmacho et al. | 116/210 X |
| 4,102,296 | * | 7/1978 | Felix | 116/210 |
| 4,120,259 | * | 10/1978 | Wilson | 116/124 |
| 4,416,433 | * | 11/1983 | Bellina | 116/210 X |
| 4,586,456 | * | 5/1986 | Forward | 40/215 X |
| 5,035,391 | * | 7/1991 | Steele et al. | 446/220 |
| 5,281,185 | * | 1/1994 | Lee | 446/488 |
| 5,514,022 | * | 5/1996 | Harris | 446/75 |
| 5,573,437 | * | 11/1996 | Van Dyke et al. | 446/71 X |

* cited by examiner

*Primary Examiner*—D. Neal Muir
(74) *Attorney, Agent, or Firm*—Brown, Martin, Haller & McClain, LLP

(57) ABSTRACT

A display apparatus has a stationary base, a floating display member secured to the base by a first cord, and a balloon secured to the floating member by a second cord. The balloon is inflated with a gas which is lighter than air, and rises upwardly to suspend the floating member at a location spaced above the base member.

13 Claims, 1 Drawing Sheet

BALLOON NOVELTY DEVICE

FIELD OF THE INVENTION

The present invention relates to the field of novelty and amusement devices, and more particularly to a balloon novelty device that can be used for entertainment or advertising purposes.

SUMMARY OF THE PRESENT INVENTION

The present invention provides a balloon novelty device that is made up of a stationary base that is coupled to a ornamental or display member by flexible cord. The display member is intended to be coupled to at least one lighter-than-air balloon which exerts an upward force on the display member, thereby suspending it above the stationary base. Both the display member and the base can have printed on them decorative designs or written messages that can be used for entertainment or advertising purposes.

DETAILED DESCRIPTION OF THE PREFERRED EMBODIMENT

A balloon novelty device will be described. In the following description, for the purposes of explanation, specific construction details, arrangements, and component descriptions are set forth in order to provide a more thorough understanding of the present invention. It will be apparent to those skilled in the art, however, that the present invention may be practiced without these specific details. In other instances, well known components and structures have not been described in detail so as not to obscure the present invention unnecessarily.

Figure 1:
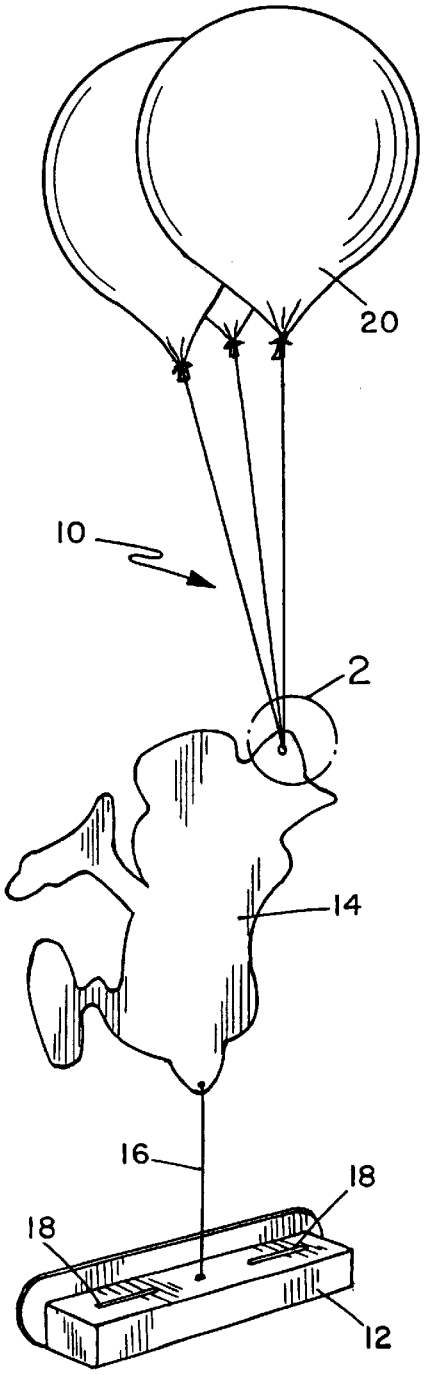
FIG. 1 is a perspective view of the preferred embodiment of the present invention.
Figure 2:
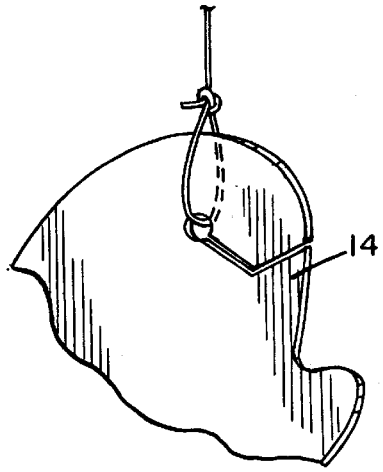
FIG. 2 is a detail view showing how the display member includes a means for attaching the balloon or balloons.

Referring first to FIG. 1, a perspective view of the preferred embodiment of the novelty device 10. The primary elements of the novelty device 10 is the stationary base 12 and the floating display member 14 which are coupled together by a suitable flexible cord or wire 16. FIG. 1 shows that a plurality of balloons 20 are each connected to the floating member 14 by a string.

It would understood that it is not necessary to use the present invention with any specific number of balloons 20. It has been determined that a plurality of balloons is most desirable, due to the extra upward force that they exert on the ornamental or display member 14 to pull it upwardly above the base member 12 so that it appears to float. However, a single balloon may be used if it is large enough so that it will lift the floating member. Therefore, whenever this description indicates that a plurality of balloons is to be used, it should be understood that no specific number is indicated, and as few as a single balloon may be connected to the floating member.

In the operation of the present invention, the floating member 14 is coupled to the balloons 20 by means of a string. The balloons are typically filled with a lighter-than-air gas, such as helium. This will result in the balloons exerting an upward force on the floating member, causing the floating member to be suspended above the stationary base 12.

The floating member is restrained by means of a flexible wire or cord 16. The cord is fixedly attached to both the stationary base and the floating member. It will be readily apparent to those skilled in the art that a variety of different materials can be utilized for the cord 16. For example, an elastic cord can be used. If it desired that the cord not be visible to the user of the novelty device, a transparent material such as nylon thread can be used.

The stationary base in the preferred embodiment is manufactured from made from a suitable material such as cardboard. It is anticipated that the base member will have a decorative design or a written message printed or drawn on it for decorative or advertising purposes. Thus, the material for the stationary base 12 should be chosen accordingly. In addition, the base should be of sufficient weight to anchor the floating member and balloons in place.

The stationary base also has formed into it a receptacle 18 for supporting the floating member 14 when the floating member is not coupled to a balloon. The receptacle in the preferred embodiment takes the form of at least one longitudinal slit 18 that is formed into the top surface of the stationary base. The receptacle allows the floating member to be displayed in an upright position, and not laid flat, when not attached to a balloon 20.

It is anticipated that the stationary base in the preferred embodiment will be sold or provided in a flat configuration. The base will then be folded into its final shape by the user of the novelty device.

The floating member 14 is made from a suitable material that is preferably lightweight. A lightweight material will allow the floating member to be suspended above the stationary base 12 by means of the upward force exerted by the lighter-than-air balloons. In the preferred embodiment, the floating member is made from a thin cardboard material. It will be apparent to those skilled in the art, however, that alternative materials can be used with equal effectiveness. For example, the floating member 14 can be manufactured from foam, heavy paper or other similar materials.

Figure 4:
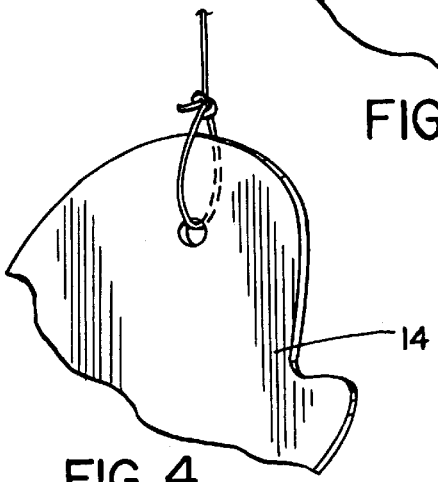
FIG. 4 illustrates an alternate embodiment of the present invention where the attachment is achieved by a simple hole.

A means for connecting the balloons 20 to the novelty device 10 is incorporated into the floating member. This attachment means can take a variety of arrangements. In the preferred embodiment, the attachment means consists of a small slit cut into the floating member. The slit is adapted to accept the string that is typically tied to the balloon. In an alternative embodiment, the attachment means may take the structure of a simple hole that passes through the floating member. The string may be tied to the floating member by the use of the hole. An example of this alternative embodiment of the attachment means is illustrated in FIG. 4.

As with the stationary base 12, the floating member 14 can be printed with a decorative design or message (not shown). In addition, the floating member can be cut to virtually any shape that is desired. The only limitation on the shape and arrangement of the floating member is that it not be too large so that it cannot be lifted by the balloons 20.

Figure 3:
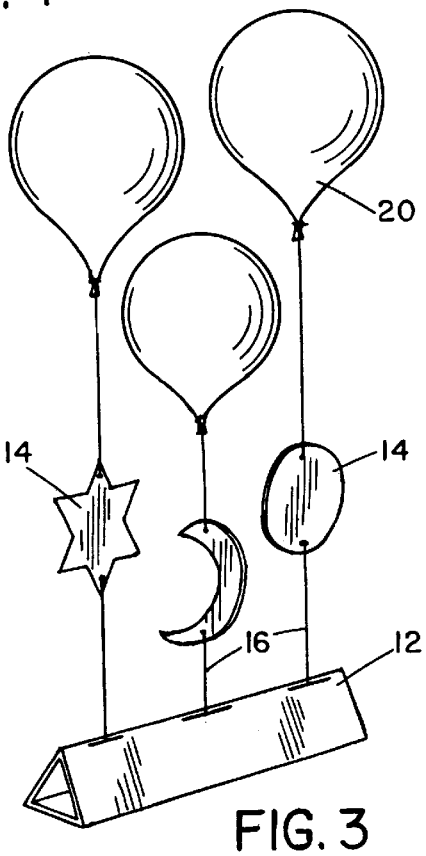
FIG. 3 illustrates an alternative embodiment of the present invention.

In the preferred embodiment of the present invention, the novelty device 10 consists of a single floating member 14 that is tethered to the stationary base 12. It will be apparent to those skilled in the art, however, that multiple floating members 14 can be utilized within the scope and spirit of the present invention. For example, an alternative embodiment of the present invention may employ multiple floating units that are connected to the base. The floating units can be connected to the base by means of differing lengths of flexible cord 16, if desired. FIG. 3 shows this type of an alternative embodiment of the present invention.

The description of the present invention has been made with respect to specific arrangements and constructions of a balloon novelty device. It will be apparent to those skilled in the art that the foregoing description is for illustrative purposes only, and that various changes and modifications can be made to the present invention without departing from the overall spirit and scope of the present invention. The full extent of the present invention is defined and limited only by the following claims.

What is claimed is:

1. A display apparatus, comprising:

a stationary base member having an outer wall, the outer wall having an opening and at least one elongate slit spaced from the opening;

a unitary display member having spaced first and second apertures and having an edge portion for selective engagement in said slits;

a first cord having a first end secured to the first aperture in the display member and a second end secured to the opening in the base member;

a second cord having a first end secured to the second aperture in the display member and a second end;

at least one inflatable balloon secured to the second end of the second cord; and whereby said balloon, when inflated with a gas which is lighter than air, rises upwardly and pulls said display member upwardly to a location at which the display member is suspended in air beneath said balloon in a generally upright configuration at a location spaced above said stationary base member whereby one of said slits support said display member in a generally upright configuration when not secured to an inflated balloon.

2. The apparatus as claimed in claim 1, wherein said base member and display member are both manufactured from cardboard.

3. The apparatus as claimed in claim 1, wherein the base member comprises a hollow, completely empty housing and has a flat lower surface for placing flat on the ground or other planar support surface.

4. A display apparatus as claimed in claim 1, wherein the display member is a generally flat, planar card having an outer periphery cut to form an ornamental shape.

5. The apparatus as claimed in claim 1, further comprising a predetermined number of display members, each display member having spaced first and second apertures a number of spaced first cords equal to the number of display members, each first cord securing the first aperture of a respective display member to the base member, a number of second cords equal to the number of display members, each second cord being secured to the second aperture of a respective display member, and a plurality of balloons comprising at least one balloon for each display member, each second cord being secured to a respective balloon.

6. The apparatus as claimed in claim 5, wherein the base member is elongated and has an upper side having a plurality of spaced openings along its length, and each first cord is secured in a respective one of said openings.

7. The apparatus as claimed in claim 5, wherein each of said display members has a different ornamental shape from the other display members.

8. The apparatus as claimed in claim 5, wherein the first cords are of different lengths.

9. The apparatus as claimed in claim 8, wherein at least some of the second cords are of different lengths.

10. The apparatus as claimed in claim 1, wherein a plurality of balloons are secured to said display member, each balloon being secured to said display member via a respective second cord.

11. A display apparatus, comprising:

a stationary base member;

a unitary display member having spaced first and second apertures;

a first cord having a first end secured to the first aperture in the display member and a second end secured to the base member;

a second cord having a first end secured to the second aperture in the display member and a second end;

at least one inflatable balloon secured to the second end of the second cord;

whereby said balloon, when inflated with a gas which is lighter than air, rises upwardly and pulls said display member upwardly to a location at which the display member is suspended in air beneath said balloon in a generally upright configuration at a location spaced above said stationary base member; and the base member having an opening for connecting the first end of the first cord to the base member, and an elongate slit on each side of the central opening, the display member having at least two edge portions for engagement in said slits to support the display member in an upright orientation when said balloon is not inflated.

12. A display apparatus, comprising:

a stationary base member comprising a hollow housing of generally elongate shape having a flat lower wall for placing flat on the ground and a flat upper wall, the housing having an opening and the upper wall having at least one slit;

a unitary, ornamental display member having spaced first and second apertures;

a cord having a first end secured to the first aperture in the display member and a second end secured to the opening in the base member;

the second aperture comprising means for securing one end of a second cord to the display member with the opposite cord end secured to a balloon inflated with a gas which is lighter than air, whereby the balloon rises upwardly and pulls said display member upwardly to a location at which the display member is suspended in air beneath said balloon in a generally upright configuration at a location spaced above said stationary base member; and the display member having at least one edge portion for engagement in said slit to support the display member on the base member in a generally upright orientation when not secured to an inflated balloon.

13. The apparatus as claimed in claim 12, wherein the housing is of generally rectangular shape and has an upright rear wall projecting upwardly above the upper wall.

* * * * *